US008899213B2

(12) United States Patent
Bejcek et al.

(10) Patent No.: US 8,899,213 B2
(45) Date of Patent: Dec. 2, 2014

(54) VACUUM CARBURETOR FUEL DRAIN SYSTEMS AND METHODS

(75) Inventors: Andrew E. Bejcek, Mebane, NC (US); Nathaniel A. Lenfert, Graham, NC (US)

(73) Assignee: Honda Motor Co., Ltd., Tokyo (JP)

( * ) Notice: Subject to any disclaimer, the term of this patent is extended or adjusted under 35 U.S.C. 154(b) by 376 days.

(21) Appl. No.: 13/371,070

(22) Filed: Feb. 10, 2012

(65) Prior Publication Data

US 2013/0206114 A1 Aug. 15, 2013

(51) Int. Cl.
*F02M 19/02* (2006.01)

(52) U.S. Cl.
USPC ..... 123/517

(58) Field of Classification Search
CPC ... F02M 19/00; F02M 19/02; F02M 19/0203; F02M 37/0023
USPC ..... 123/73 AD, 325, 332, 350, 363, 366, 123/436, 481, 179.4, 198 DB, 198 DC, 514, 123/517, 518; 261/36.2
See application file for complete search history.

(56) References Cited

U.S. PATENT DOCUMENTS

| | | | |
|---|---|---|---|
| 2,965,086 A | 12/1960 | Gregory et al. | |
| 2,986,133 A | 5/1961 | Mattson | |
| 3,601,107 A | 8/1971 | Rohrbacher et al. | |
| 3,640,257 A | 2/1972 | Cornelius | |
| 7,263,981 B2 | 9/2007 | Woody | |
| 7,424,884 B2 | 9/2008 | Woody | |
| 7,568,472 B2 | 8/2009 | Woody | |
| 7,775,189 B2 * | 8/2010 | Bejcek et al. | 123/179.16 |
| 7,775,194 B2 | 8/2010 | Kono et al. | |
| 2008/0178850 A1 | 7/2008 | Bejcek et al. | |

FOREIGN PATENT DOCUMENTS

| | | |
|---|---|---|
| JP | 60-27808 | 3/1981 |
| JP | 1-59427 | 11/1983 |
| JP | 2008-038611 | 2/2008 |

* cited by examiner

*Primary Examiner* — Hai Huynh
(74) *Attorney, Agent, or Firm* — Jenkins, Wilson, Taylor & Hunt, P.A.

(57) ABSTRACT

Systems and methods for draining fuel from a carburetor of a combustion engine can include a first control valve in communication between a fuel source and a fuel chamber of a carburetor and a second control valve in communication between the fuel chamber of the carburetor and a drain reservoir. The first and second control valves can be coupled and operable such that, upon disengagement of the engine, the first control valve can be closed to block a supply of fuel to the fuel chamber, and the second control valve can be opened to connect the drain reservoir to the fuel chamber, which can operate to draw liquid fuel from the fuel chamber into the drain reservoir. The fuel can then be moved from the drain reservoir into a fuel storage tank, where it can be stored until needed by the carburetor.

16 Claims, 4 Drawing Sheets

VACUUM CARBURETOR FUEL DRAIN SYSTEMS AND METHODS

TECHNICAL FIELD

The subject matter disclosed herein relates generally to fuel systems for combustion engines. More particularly, the subject matter disclosed herein relates to systems and methods for draining fuel from a carburetor.

BACKGROUND

Many fuel system problems in mechanical equipment stem from the residual fuel that is left in the carburetor during periods of long storage. In some cases, the fuel polymerizes and forms a hard substance commonly referred to as "varnish" or "gum". This substance can block the small passages and orifices in the carburetor that are critical to properly metering the air/fuel charge. As a result of these types of blockages, the engine can run poorly or not at all. In addition, light components of the gasoline blend can tend to evaporate, leaving behind a fuel that has a very low vapor pressure, which again can result in the engine being very difficult or impossible to start. Further still, residual fuel in the carburetor can also result in corrosion in the carburetor due to ethanol and water content in the fuel. This corrosion can have the same effect as gum or varnish, blocking or restricting important passages in the carburetor.

The problem of residual fuel in the carburetor can be attributed in many cases to the fact that most single-cylinder, general-purpose gasoline engines currently use a float carburetor to meter and supply the air-fuel charge to the engine. Typically, the fuel delivery to the carburetor is regulated by a float-actuated needle valve in the carburetor, which maintains the fuel level in the carburetor during operation. When the unit is stored, this valve also continues to maintain the fuel level, supplying additional fuel from the fuel tank as fuel evaporates from the carburetor bowl. This additional supply can be stopped using some form of fuel shutoff valve, which can in some cases be linked to the engine shutoff.

Even with a fuel shutoff, however, there is often a significant amount of residual fuel remaining in the carburetor when an engine is put into storage, which can lead to many fuel system problems. To address this problem, some manufacturers include a drain in the carburetor, which allows the user to drain the carburetor in preparation for storage. In typical systems, however, a screwdriver, wrench, or other implement is required to open this drain. Additionally, many small engine operators do not understand the importance of draining the fuel, and therefore they do not drain the fuel from the carburetor before storing the engine.

Accordingly, it would be desirable for residual fuel remaining in the carburetor after engine shutoff to be automatically (or at least easily) drained so as to avoid the problems that can be caused by such residual fuel.

SUMMARY

In accordance with this disclosure, systems and methods for draining fuel from a carburetor are provided. In one aspect, a control assembly for a fuel delivery and recovery system for use with a combustion engine is provided. The control assembly can comprise a first control valve in communication between a fuel source and a fuel chamber of a carburetor, a second control valve in communication between the fuel chamber of the carburetor and a drain reservoir, and an ignition control switch. The first control valve can be movable between an open position in which fuel is able to flow from the fuel source to the fuel chamber and a closed position in which fuel is prevented from flowing from the fuel source to the fuel chamber. The second control valve can be movable between an open position in which fuel is able to flow from the fuel chamber to the drain reservoir and a closed position in which fuel is prevented from flowing from the fuel chamber to the drain reservoir. The ignition control switch can be movable between an "ON" position in which the engine is engaged and an "OFF" position in which the engine is disengaged. The first control valve, the second control valve, and the ignition control switch can be coupled together, such as by mechanical linkage or any other suitable manner, such that the second control valve is in its closed position and the first control valve is in its open position when the ignition control switch is in its "ON" position, and the second control valve is in its open position and the first control valve is in its closed position when the ignition control switch is in its "OFF" position.

In another aspect, a fuel delivery and recovery system for use with a combustion engine is provided. The system can comprise a fuel source, a carburetor comprising a fuel chamber in communication with the fuel source for receiving liquid fuel from the fuel source, a first control valve in communication between the fuel source and the carburetor, a drain reservoir connected to the fuel chamber, the fuel source, and a vacuum source, and a second control valve in communication between the fuel chamber of the carburetor and the drain reservoir. The first control valve and the second control valve can be coupled together such that when the first control valve is in a closed position in which fuel is prevented from flowing from the fuel source to the carburetor. Conversely the second control valve can be in a closed position in which fuel is prevented from flowing from the fuel chamber to the drain reservoir when the first control valve is in an open position in which fuel is able to flow from the fuel source to the carburetor. In addition, the vacuum source can be operable to reduce the air pressure in the drain reservoir to be less than an air pressure in the fuel chamber, whereby when the second control valve is in its open position, fuel flows from the fuel chamber to the drain reservoir.

In yet another aspect, a method for recovering unused fuel in a fuel delivery system for a combustion engine is provided. The method can comprise reducing air pressure in a drain reservoir to be less than an air pressure in a fuel chamber of a carburetor during operation of the engine, and, upon disengagement of the engine, blocking a supply of fuel to the fuel chamber and connecting the drain reservoir to the fuel chamber to draw liquid fuel from the fuel chamber into the drain reservoir.

Although some of the aspects of the subject matter disclosed herein have been stated hereinabove, and which are achieved in whole or in part by the presently disclosed subject matter, other aspects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

DETAILED DESCRIPTION

Figure 1A:
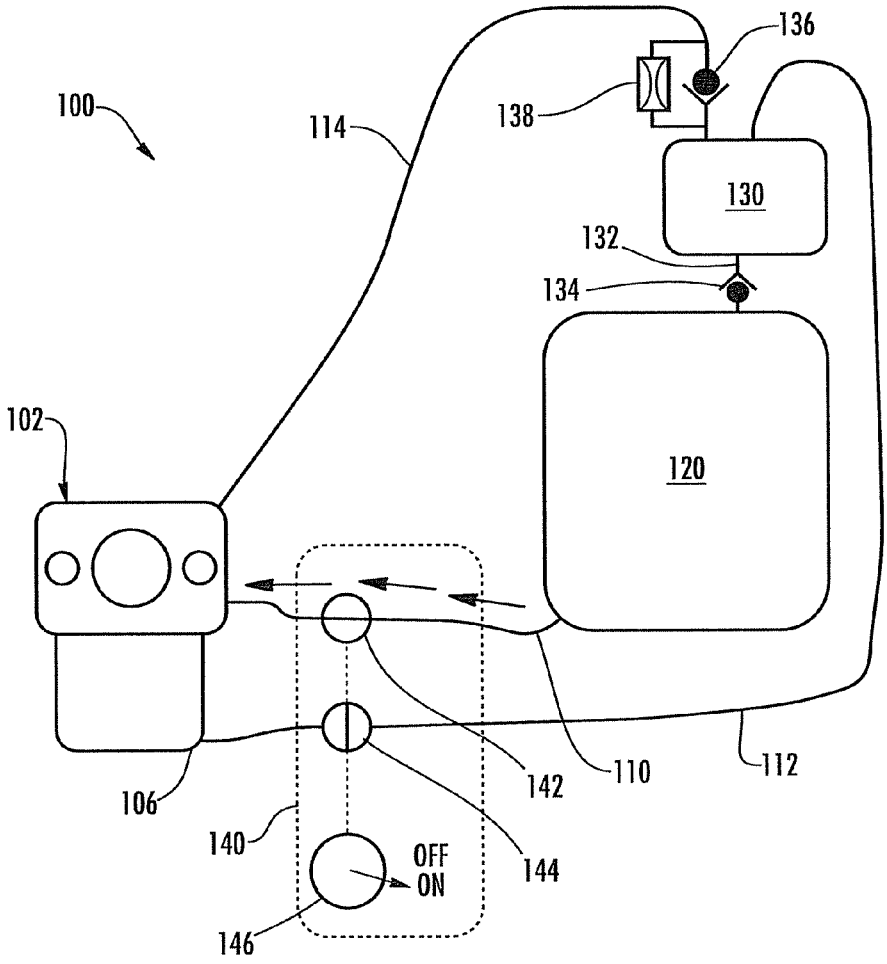
FIG. 1A is a schematic view of a fuel delivery and recovery system for use with a combustion engine in a first operating position according to an embodiment of the presently disclosed subject matter.

The present subject matter provides systems and methods for draining fuel from a carburetor. In one aspect shown in FIGS. 1A through 2, for example, the present subject matter provides a system, generally designated 100, for draining fuel from a carburetor 102. Carburetor 102 can be connected to a fuel source that can supply fuel to carburetor 102. For instance, carburetor 102 can be connected to a fuel tank 120 through a fuel feed line 110. Fuel supplied to carburetor 102 from fuel tank 120 can be introduced and stored in a fuel chamber 104 (e.g., a float chamber as shown in FIG. 2) until it is supplied into the engine air stream. As noted above, the fuel delivery to carburetor 102 can be regulated by a float-actuated needle valve or by some other metering and delivery system known to those having skill in the art.

Contrary to typical systems, however, when it is desired to remove residual fuel from fuel chamber 104 of carburetor 102 (e.g., after engine shutdown), the residual fuel can be drawn out of a fuel drain 106 in carburetor 102 and to a fuel return line 112 that directs the fuel back towards fuel tank 120. Specifically, fuel return line 112 can be connected to a drain reservoir 130. Fuel that is collected in drain reservoir 130 can subsequently be supplied back to fuel tank 120, such as through a drain connection line 132. In addition, a first one-way valve 134 (i.e., a check valve) can be positioned along drain connection line 132 to ensure that fuel is only able to flow from drain reservoir 130 into fuel tank 120.

To control the flow of fuel from carburetor 102 to drain reservoir 130, the pressure within drain reservoir 130 can be controlled to be less than the pressure in fuel chamber 104 of carburetor 102, which is usually substantially equivalent to atmospheric pressure. This pressure control can be accomplished by connecting drain reservoir 130 to a vacuum source.

Specifically, drain reservoir 130 can be connected to a reduced pressure environment that can exist in portions of the engine intake tract (e.g., partial vacuum established at the carburetor outlet/engine intake manifold). As shown in FIGS. 1A through 2, for example, drain reservoir 130 can be connected by a pressurization line 114 to an outlet region 108 of carburetor 102 or that exhibits a reduced pressure atmosphere during operation of the engine and is thus a vacuum source. Alternatively, drain reservoir 130 can be connected to any other source of low pressure, such as an intake port or any other suitable source.

The system can further include a second one-way valve 136 in parallel with a small orifice 138 along pressurization line 114. Second one-way valve 136 can allow drain reservoir 130 to attain a lower pressure than the average value of the pulsating intake port vacuum signal. Additionally, it can retain the "negative" pressure for some time after the engine is shut off. Orifice 138 can allow drain reservoir 130 to eventually return to atmospheric pressure after the engine is shut off so that the fuel can drain back into fuel tank 120 instead of accumulating in drain reservoir 130.

In the arrangement described above and shown in FIGS. 1A through 1C, the system 100 can operate to use the engine vacuum to "charge" drain reservoir 130 to a "negative" pressure (i.e., reduced relative to atmospheric pressure) while the engine is running. After the engine is shut down, the negative pressure in drain reservoir 130 can be used to evacuate at least some of the fuel in the fuel chamber 104 of carburetor 102. Once removed from carburetor 102, the fuel can eventually be drained back into fuel tank 120. For example, drain reservoir 130 can be positioned above fuel tank 120 such that any fuel collected in drain reservoir 130 can largely be moved into fuel tank 120 by gravity alone.

System 100 can be made substantially autonomous using a control assembly 140 that can couple two valves for simultaneous actuation: a first control valve 142 being positioned along fuel feed line 110 for controlling the carburetor fuel supply passage shutoff, and a second control valve 144 positioned along fuel return line 112 for controlling the fuel drain passage shutoff. The actuation of first control valve 142 and second control valve 144 can be coupled and operable such that the valves are opened in a mutually exclusive manner. In other words, the operation of first control valve 142 and second control valve 144 can be coupled such that second control valve 144 is in its open position when first control valve 142 is in its closed position, and conversely first control valve 142 is in its open position when second control valve 144 is in its closed position.

Specifically, during operation of the engine, control assembly 140 can be configured as shown in FIG. 1A such that first control valve 142 is in an "open" position, whereby fuel is permitted to flow from fuel tank 120 through fuel feed line 110 to carburetor 102. Concurrently, second control valve 144 can be in a "closed" position, whereby fuel is prevented from flowing from carburetor 102 through fuel return line 112 to drain reservoir 130. Although flow along fuel return line 112 is prevented, the connection of drain reservoir 130 to outlet portion 108 of carburetor 102 can remain open, thereby reducing the pressure in drain reservoir 130. It should be noted that because of first one-way valve 134, the reduced pressure environment created in drain reservoir 130 prevents fuel from being drawn from fuel tank 120 into drain reservoir 130.

Figure 1B:
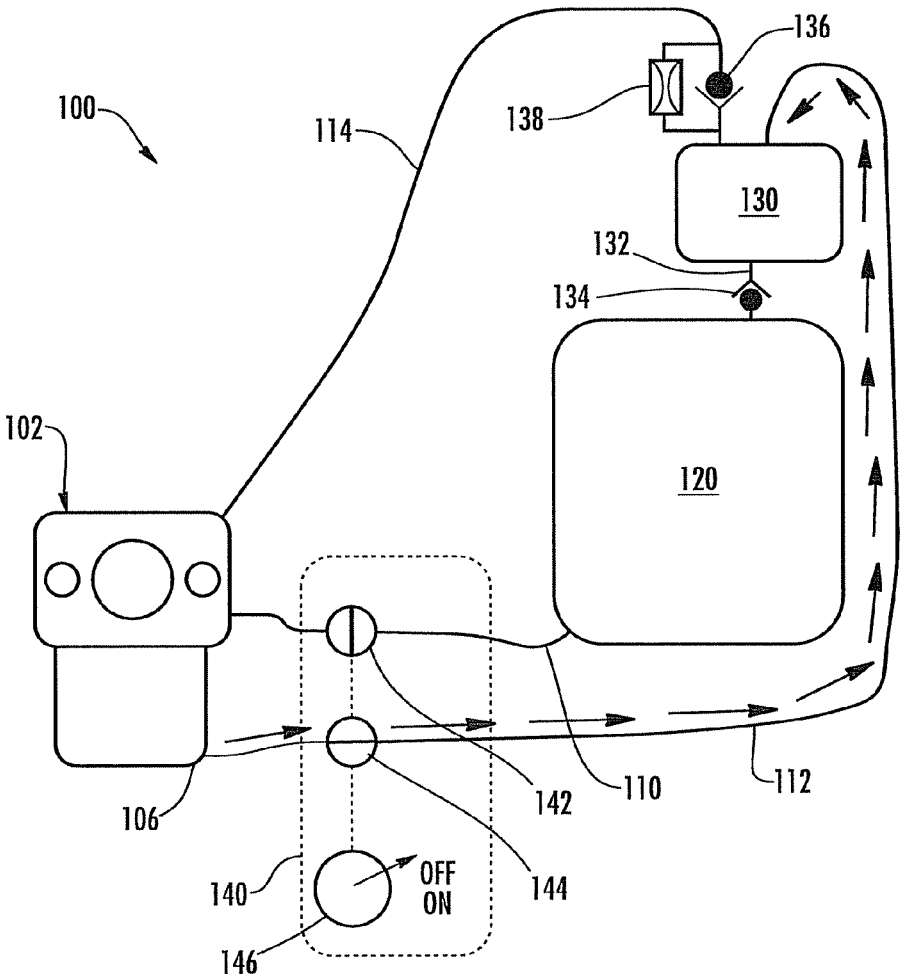
FIGS. 1B and 1C are schematic views of a fuel delivery and recovery system for use with a combustion engine in a second operating position according to an embodiment of the presently disclosed subject matter.
Figure 1C:
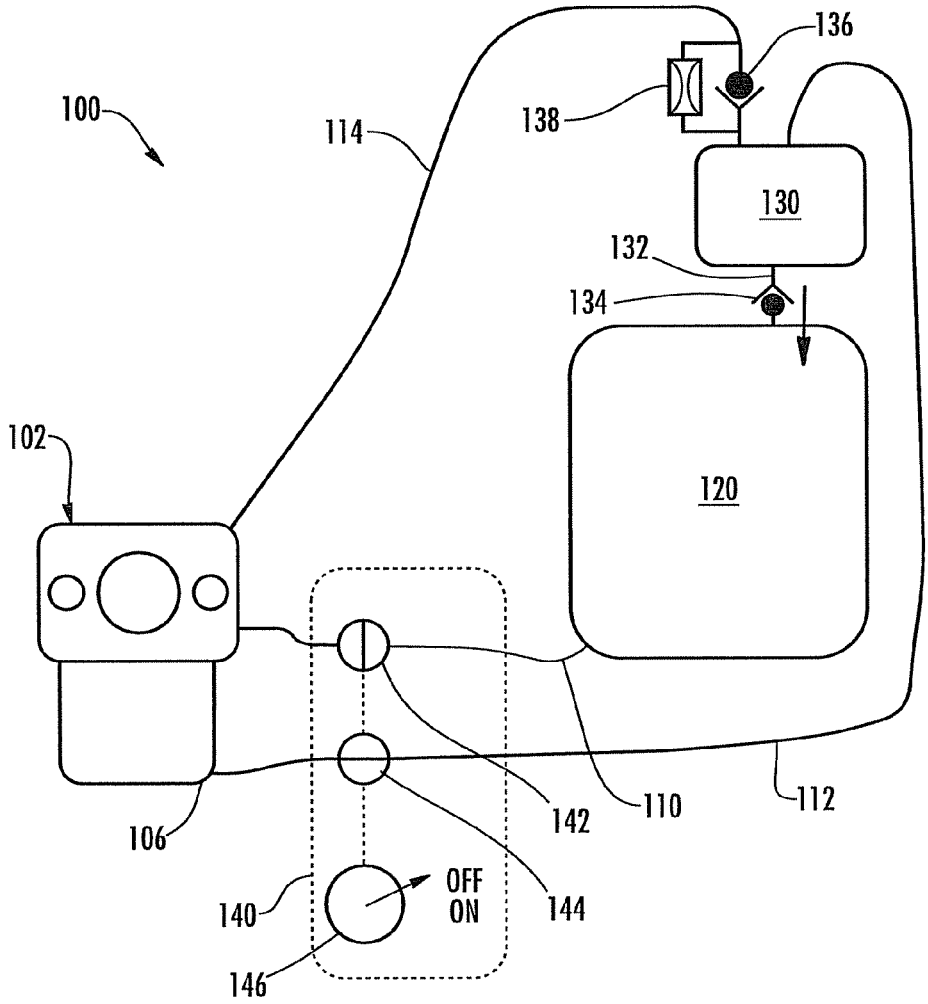
Figure 2:
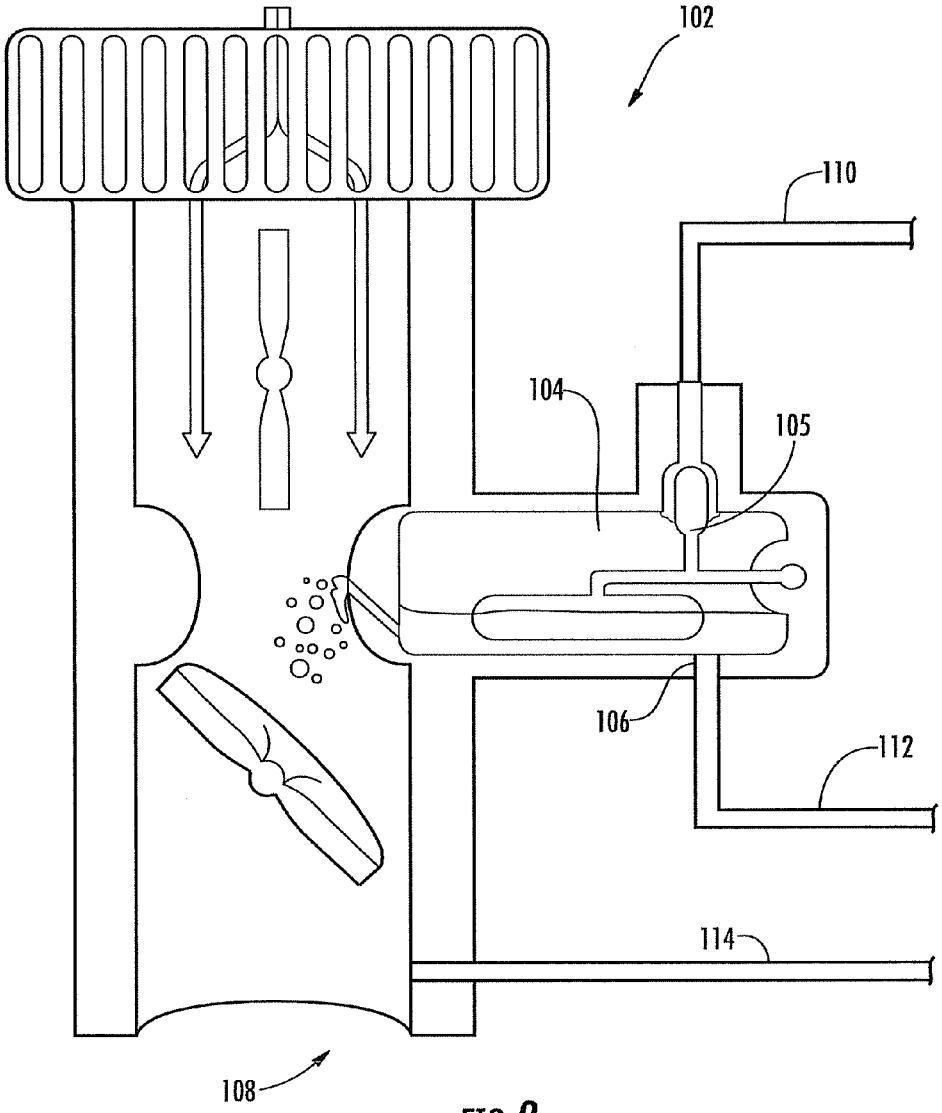
FIG. 2 is a side cutaway view of a carburetor of a combustion engine configured for connection to a fuel delivery and recovery system according to an embodiment of the presently disclosed subject matter.

When the engine is stopped, control assembly 140 can be configured as shown in FIGS. 1B and 1C such that first control valve 142 is in a "closed" position, whereby fuel flow from fuel tank 120 to carburetor 102 is stopped, and second control valve 144 is in an "open" position, whereby fuel can flow out of fuel chamber 104 of carburetor 102 (e.g., through fuel drain 106) through fuel return line 112 to drain reservoir 130. Because of the reduced pressure environment that is developed in drain reservoir 130 during the operation of the engine, fuel can be drawn from fuel chamber 104 into drain reservoir 130 as shown in FIG. 1B, substantially emptying fuel chamber 104 of any residual fuel.

Further, because operation of the engine is stopped in this arrangement, the partial vacuum developed in the engine intake tract will eventually diminish (i.e., pressure will increase back towards atmospheric pressure). As a result, the connection of drain reservoir 130 to carburetor 102 via pressurization line 114 stops acting to reduce the pressure in drain reservoir 130. Accordingly, if a pressure release mechanism is provided, the pressure in drain reservoir 130 can equalize with the pressure in fuel tank 120. For example, as discussed above, orifice 138 can operate to equalize the pressure in drain reservoir 130 with the pressure in outlet portion 108. During operation of the engine, equalization of these pressures results in the air pressure in drain reservoir 130 being reduced to be at or near the partial vacuum established at outlet portion 108. When engine operation is discontinued, however, the pressure at outlet portion 108 will tend to gradually increase towards atmospheric pressure, and thus the pressure equalization effected by orifice 138 can allow the pressure in drain reservoir 130 to likewise gradually return to atmospheric pressure. Once the pressure in drain reservoir 130 is sufficiently increased such that there is substantially no pressure differential between drain reservoir 130 and fuel tank 120, fuel can flow through first one-way valve 134 into fuel tank 120.

In addition, the operation of first control valve 142 and second control valve 144 can further be linked to an ignition control switch 146 used to control the ignition kill. Specifically, when ignition control switch 146 is in an "ON" position (See, e.g., FIG. 1A) in which the engine is engaged, first control valve 142 is in an open position and second control valve 144 is in a closed position. When ignition control switch 146 is moved to an "OFF" position (See, e.g., FIGS. 1B and 1C), thereby stopping operation of the engine, first control valve 142 can be moved to a closed position and second control valve 144 can be moved to an open position. In this way, as discussed above, the flow path from fuel tank 120 to carburetor 102 can be open only during operation of the engine, and the fuel path from carburetor 102 to drain reservoir 130 can be open only upon the disengagement of the engine. As a result, control assembly 140 can operate to allow the normal supply of fuel to carburetor 102 during operation of the engine, but upon disengagement of the engine, fuel chamber 104 of carburetor 102 can be automatically drained, thereby helping to avoid the problems that can be caused by residual fuel.

The present subject matter can be embodied in other forms without departure from the spirit and essential characteristics thereof. The embodiments described therefore are to be considered in all respects as illustrative and not restrictive. Although the present subject matter has been described in terms of certain preferred embodiments, other embodiments that are apparent to those of ordinary skill in the art are also within the scope of the present subject matter.

What is claimed is:

1. A control assembly for a fuel delivery and recovery system for use with a combustion engine, the control assembly comprising:

a fuel source in liquid communication with a fuel chamber of a carburetor;

a first control valve in fluid communication with the fuel source and the fuel chamber, the first control valve being movable between an open position in which fuel is able to flow from the fuel source to the fuel chamber and a closed position in which fuel is prevented from flowing from the fuel source to the fuel chamber;

a second control valve in fluid communication with the fuel chamber of the carburetor and a drain reservoir, the second control valve being movable between an open position allowing flow of fuel from the fuel chamber to the drain reservoir and a closed position preventing flow of fuel from the fuel chamber to the drain reservoir; and an ignition control switch movable between an "ON" position in which the engine is engaged and an "OFF" position in which the engine is disengaged;

wherein the first control valve, the second control valve, and the ignition control switch are coupled and operable such that the second control valve is in its closed position and the first control valve is in its open position when the ignition control switch is in its "ON" position, and the second control valve is in its open position and the first control valve is in its closed position when the ignition control switch is in its "OFF" position.

2. A fuel delivery and recovery system for use with a combustion engine, the system comprising:

a fuel source;

a carburetor comprising a fuel chamber in communication with the fuel source for receiving liquid fuel from the fuel source;

a first control valve in communication with the fuel source and the carburetor, the first control valve being movable between an open position in which fuel is able to flow from the fuel source to the carburetor and a closed position in which fuel is prevented from flowing from the fuel source to the carburetor;

a drain reservoir connected to the fuel chamber, the fuel source, and a vacuum source, the vacuum source being operable to reduce the air pressure in the drain reservoir to be less than an air pressure in the fuel chamber; and a second control valve in communication with the fuel chamber of the carburetor and the drain reservoir, the second control valve being movable between an open position in which fuel is able to flow from the fuel chamber to the drain reservoir and a closed position in which fuel is prevented from flowing from the fuel chamber to the drain reservoir;

wherein the first control valve and the second control valve are coupled and operable such that the second control valve is in its open position when the first control valve is in its closed position, and the second control valve is in its closed position when the first control valve is in its open position.

3. The system of claim 2, wherein the vacuum source comprises a region of an engine intake tract having an air pressure that is less than atmospheric pressure.

4. The system of claim 3, wherein the region of an engine intake tract comprises an outlet region of the carburetor, an insulator of the carburetor, or an intake port.

5. The system of claim 2, wherein the first control valve and the second control valve are coupled to an ignition control switch movable between an "ON" position in which the engine is engaged and an "OFF" position in which the engine is disengaged; and wherein the first control valve is in its open position when the ignition control switch is in its "ON" position, and the second control valve is in its open position when the ignition control switch is in its "OFF" position.

6. The system of claim 2, comprising a first one-way valve positioned in communication between the drain reservoir and the fuel source for preventing fuel from flowing from the fuel source to the drain reservoir.

7. The system of claim 2, comprising a second one-way valve positioned in communication between the drain reservoir and the vacuum source for maintaining a pressure in the drain reservoir that is lower than atmospheric pressure.

8. The system of claim 7, comprising a pressure release mechanism positioned in parallel with the second one-way valve between the drain reservoir and the vacuum source for equalizing pressure between the drain reservoir and the vacuum source.

9. A method for recovering unused fuel in a fuel delivery system for a combustion engine, the method comprising:

reducing air pressure in a drain reservoir to be less than an air pressure in a fuel chamber of a carburetor during operation of the engine;

upon disengagement of the engine, blocking a supply of fuel from a fuel supply to the fuel chamber and connecting the drain reservoir to the fuel chamber to draw liquid fuel from the fuel chamber into the drain reservoir; and flowing the liquid fuel from the drain reservoir to the fuel supply.

10. The method of claim 9, wherein reducing air pressure in the drain reservoir comprises connecting the drain reservoir to a vacuum source.

11. The method of claim 10, wherein connecting the drain reservoir to a vacuum source comprises connecting the drain reservoir to a region of an engine intake tract having an air pressure that is less than atmospheric pressure.

12. The method of claim 11, wherein connecting the drain reservoir to a region of an engine intake tract comprises connecting the drain reservoir to an outlet region of the carburetor, an insulator of the carburetor, or an intake port.

13. The method of claim 9, wherein blocking a supply of fuel to the fuel chamber comprises closing a first control valve in communication between a fuel source and the fuel chamber; and connecting the drain reservoir to the fuel chamber comprises opening a second control valve in communication between the fuel chamber and the drain reservoir.

14. The method of claim 13, wherein the first control valve and the second control valve are coupled and operable such that the second control valve is opened at substantially the same time that the first control valve is closed.

15. The method of claim 14, wherein the first control valve and the second control valve are coupled to an ignition control switch movable between an "ON" position and an "OFF" position; and wherein moving the ignition control switch is to its "OFF" position closes the first control valve and opens the second control valve.

16. The method of claim 9, wherein flowing the liquid fuel from the drain reservoir to a fuel supply comprises:

increasing the air pressure in the drain reservoir to be substantially equal to or greater than air pressure in the fuel supply; and connecting the drain reservoir to the fuel supply.

* * * * *